US006565058B1

(12) United States Patent
Holland

(10) Patent No.: US 6,565,058 B1
(45) Date of Patent: May 20, 2003

(54) PROMOTIONAL NOTE HOLDING APPARATUS

(75) Inventor: Jason S. Holland, Raleigh, NC (US)

(73) Assignee: Adstracts, Inc., Raleigh, NC (US)

( * ) Notice: Subject to any disclaimer, the term of this patent is extended or adjusted under 35 U.S.C. 154(b) by 0 days.

(21) Appl. No.: 10/074,112

(22) Filed: Feb. 11, 2002

(51) Int. Cl.[7] ..... A47B 19/00

(52) U.S. Cl. ..... 248/441.1; 248/316.2; 248/316.5; 40/658; 24/503; 24/537

(58) Field of Search ..... 248/316.5, 316.2, 248/441.1, 451, 473, 113; 40/658, 124.01, 666, 606, 124.07, 739, 738, 747, 324, 652, 647; 24/67 R, 67.11, 67.3, 536, 68 R, 67.5, 67.7, 503, 515, 537

(56) References Cited

U.S. PATENT DOCUMENTS

| | | | | | |
|---|---|---|---|---|---|
| 327,440 | A | | 9/1885 | Heysinger | |
| 774,036 | A | | 11/1904 | Burgess | |
| 1,078,805 | A | * | 11/1913 | Schahl | |
| 1,681,586 | A | | 8/1928 | Kessler | |
| 1,768,675 | A | | 7/1930 | Egan | |
| 2,058,102 | A | * | 10/1936 | Philipp | |
| 2,603,357 | A | * | 7/1952 | Zakos | |
| 2,869,210 | A | * | 1/1959 | Schneider | |
| 3,556,454 | A | * | 1/1971 | Huver | 248/317 |
| 3,896,526 | A | * | 7/1975 | Joiner | 24/67.1 |
| 3,924,303 | A | * | 12/1975 | Elliott | 24/137 R |
| 3,994,460 | A | | 11/1976 | Geiger | 248/176 |
| 4,075,773 | A | | 2/1978 | Daster | 40/11 |
| 4,125,243 | A | | 11/1978 | Liptak | 248/473 |
| 4,324,125 | A | * | 4/1982 | Jarman et al. | 72/479 |
| D279,991 | S | | 8/1985 | Lehman | D19/21 |
| 4,991,268 | A | * | 2/1991 | Ho | 24/67.3 |
| D347,858 | S | | 6/1994 | Miller et al. | D19/90 |
| 5,505,421 | A | | 4/1996 | Marthaler | 248/442.2 |
| 5,667,183 | A | | 9/1997 | Hiromori | 248/451 |
| 5,775,663 | A | | 7/1998 | Fitzsimmons et al. | 248/450 |
| 5,845,889 | A | | 12/1998 | Suzuki | 248/451 |
| 5,857,654 | A | | 1/1999 | Berman | 248/441.1 |
| D418,876 | S | | 1/2000 | Rhoden | D19/88 |
| 6,059,249 | A | | 5/2000 | Scatterday | 248/450 |
| D438,253 | S | | 2/2001 | Korowitz et al. | D19/78 |
| 6,267,346 | B1 | | 7/2001 | Dill et al. | 248/473 |
| D448,418 | S | | 9/2001 | Langenbach | D19/90 |
| D451,962 | S | | 12/2001 | Thornton | D19/78 |
| 6,367,761 | B1 | * | 4/2002 | Suzuki | 248/451 |
| 6,481,687 | B2 | * | 11/2002 | Najmi | 248/452 |

FOREIGN PATENT DOCUMENTS

| | | | |
|---|---|---|---|
| EP | 1095593 A1 | * | 10/2000 |
| JP | 11-180000 | * | 7/1999 |
| JP | 2002-19348 A | * | 1/2002 |

* cited by examiner

*Primary Examiner*—Gwendolyn Baxter
(74) *Attorney, Agent, or Firm*—Myers Bigel Sibley & Sajovec

(57) ABSTRACT

Promotional devices configured to removably support articles (e.g., papers, photographs, etc.) for viewing are provided. A device includes a housing and a pair of arms pivotally disposed within the housing in adjacent spaced-apart relationship. The housing includes a base portion that is configured to be supported on a surface and an upper portion that is movably secured to the base portion. The housing upper portion is movable between a distal position and a proximal position relative to the housing base portion. Movement of the housing upper portion from the distal position to the proximal position causes the upper end portions of the arms to separate so that an article can be placed therebetween. The arms are urged together so as to retain the article placed therebetween and the housing upper portion is moved to the distal position.

15 Claims, 4 Drawing Sheets

PROMOTIONAL NOTE HOLDING APPARATUS

FIELD OF THE INVENTION

The present invention relates generally to vehicles and, more particularly, to floor coverings for use within vehicles.

BACKGROUND OF THE INVENTION

The use of promotional items has proliferated in today's increasingly competitive marketplace, where companies are constantly seeking more effective and new ways to market their products. In the healthcare industry, physicians and other healthcare providers often receive promotional articles from vendors of healthcare-related products, such as pharmaceutical products. These promotional articles often include "everyday" items, such as writing pads, calendars, containers, and pens that have promotional information (indicia) printed thereon. For example, pharmaceutical companies often provide physicians with writing pens having the name of a particular pharmaceutical product printed thereon with the hopes that the pens will help remind the physicians to prescribe the particular pharmaceutical product.

Unfortunately, because of lack of distinctiveness, many promotional articles provided to healthcare providers often become "lost-in-the-shuffle" with other promotional articles. Thus, there is a need for distinctive, more effective promotional products directed to physicians and other healthcare providers.

SUMMARY OF THE INVENTION

In view of the above discussion, promotional devices configured to removably support articles (e.g., papers, photographs, etc.) for viewing are provided. According to embodiments of the present invention, a device includes a housing and a pair of arms pivotally disposed within the housing in adjacent spaced-apart relationship. The housing includes a base portion that is configured to be supported op a surface and an upper portion that is movably secured to the base portion. The housing upper portion is movable between a distal position and a proximal position relative to the housing base portion.

The arms have upper end portions and opposite lower end portions. The upper end portions of the arms have an arcuate configuration and are configured to matingly engage when the housing upper portion is in the distal position. The lower end portions of the arms angle away from each other to facilitate engagement with the housing upper portion for causing the upper end portions of the arms to pivot away from each other. The housing upper portion is configured to engage the lower end portions of the arms such that movement of the housing upper portion to the proximal position causes the upper end portions of the arms to pivot away from each other so that an article can be placed therebetween. A spring is disposed within the housing and is configured to urge the upper end portions of the arms together so as to removably support an article placed therebetween for viewing. The housing upper portion is moved to the distal position when the upper end portions of the arms are urged together by the spring.

In operation, a user moves the housing upper portion from the distal position to the proximal position, whereby the upper end portions of the arms are separated from each other. An article such as a piece of paper, photograph, etc., is placed between the upper end portions of the arms. The user releases the housing upper portion and the spring pivotally urges the upper end portions of the arms together. Movement of the arms causes the housing upper portion to move to the distal position.

According to embodiments of the present invention, promotional indicia may be provided on one or more portions of the devices of the present invention. For example, promotional indicia may be provided on portions of the housing upper portion and/or base portion, and/or may be provided on one or more of the upper portions of the arms.

According to embodiments of the present invention, a promotional device that is configured to removably support an article for viewing includes a pair of arms configured to removably support an article for viewing placed therebetween that are entirely disposed within a housing.

DETAILED DESCRIPTION OF THE INVENTION

Figure 1:
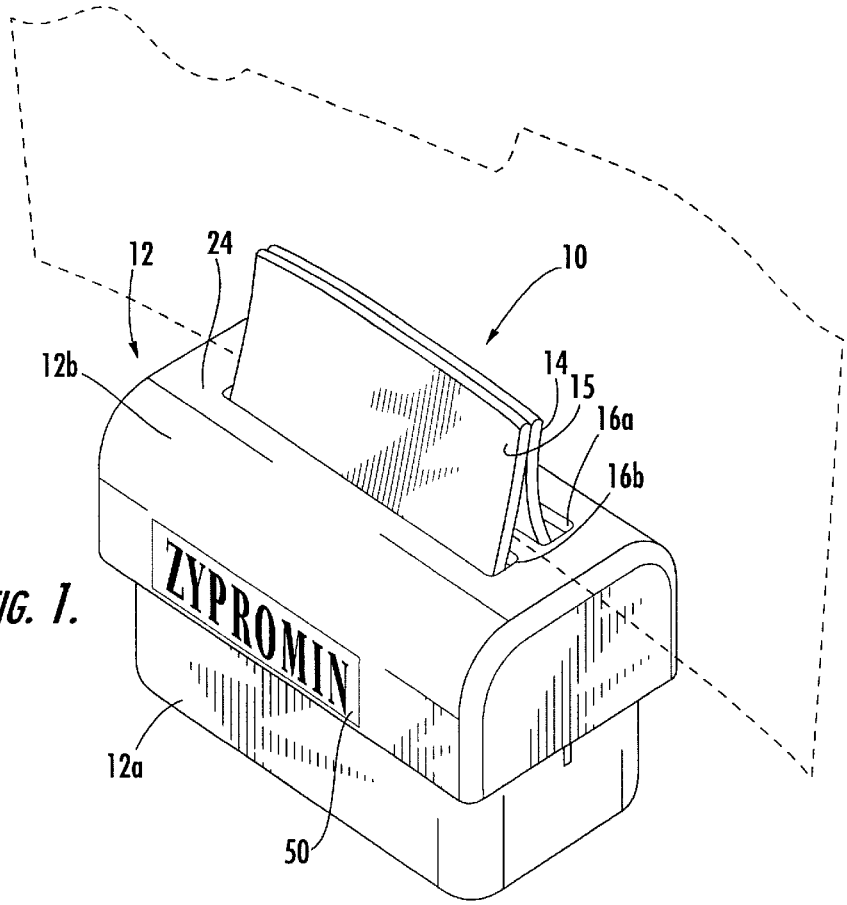
FIG. 1 is a perspective view of a promotional device that is configured to removably support an article for viewing according to embodiments of the present invention.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the thickness of lines, layers and regions may be exaggerated for clarity. It will be understood that when an element such as a layer, region, substrate, or panel is referred to as being "on" another element, it can be directly on the other element or intervening elements may also be present. In contrast, when an element is referred to as being "directly on" another element, there are no intervening elements present. It will be understood that when an element is referred to as being "connected" or "attached" to another element, it can be directly connected or attached to the other element or intervening elements may also be present. In contrast, when an element is referred to as being "directly connected" or "directly attached" to another element, there are no intervening elements present. The terms "upwardly", "downwardly", "vertical", "horizontal" and the like are used herein for the purpose of explanation only.

Referring to FIGS. 1–7, a promotional device 10 according to embodiments of the present invention that is configured to removably support an article (e.g., paper, photograph, etc.) for viewing is illustrated. The illustrated device 10 includes a housing 12 and a pair of arms 14, 15 pivotally disposed within the housing 12. The housing 12 includes a base portion 12*a* that is configured to be supported on a surface and an upper portion 12*b* that is movably secured to the base portion 12*a*. The housing upper portion 12*b* is movable between a distal position (FIG. 2) and a proximal position (FIG. 3) relative to the housing base portion 12. As illustrated in FIGS. 5A–5B, tabs 17*a* on the housing base portion 12*a* are configured to engage tabs 17*b* to prevent housing upper portion 12*b* from being completely removed from the housing base portion 12*a* during normal operation of the device 10.

Figure 4:
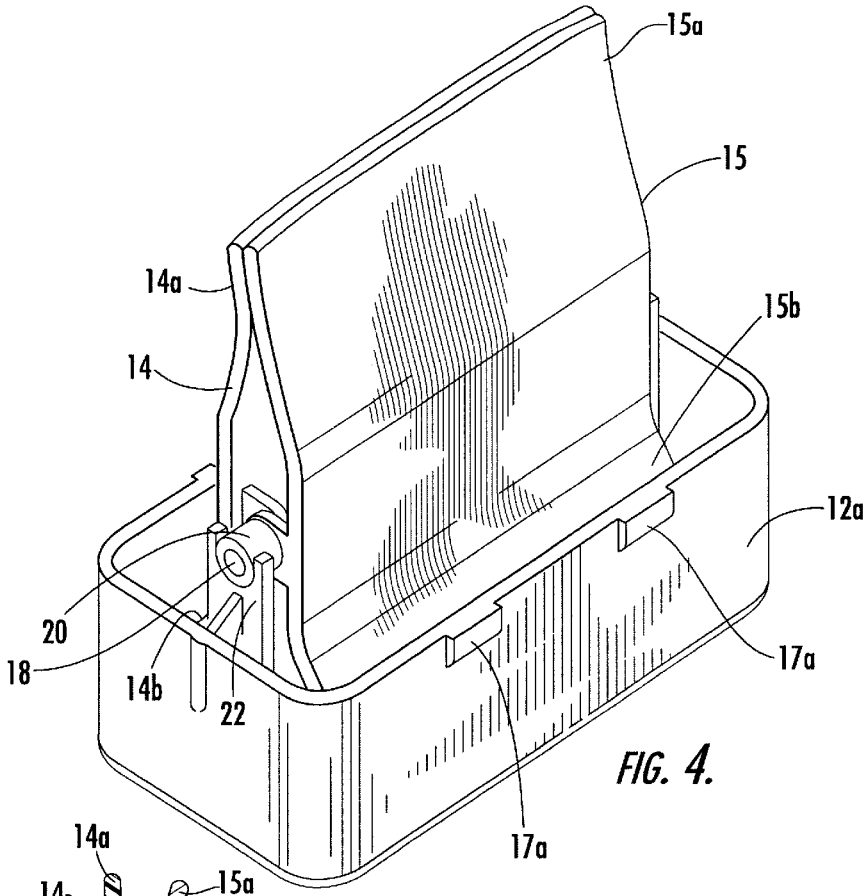
FIG. 4 is a perspective view of the device of FIG. 1 with the housing upper portion removed.
Figure 5A:
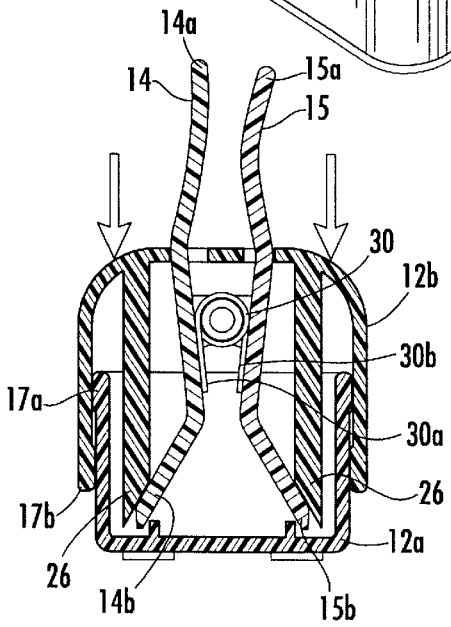
FIG. 5A is a cross-sectional view of the device of FIG. 1 illustrating the housing upper portion in a proximal position such that the upper end portions of the arms are pivoted away from each other so that an article can be placed therebetween.
Figure 5B:
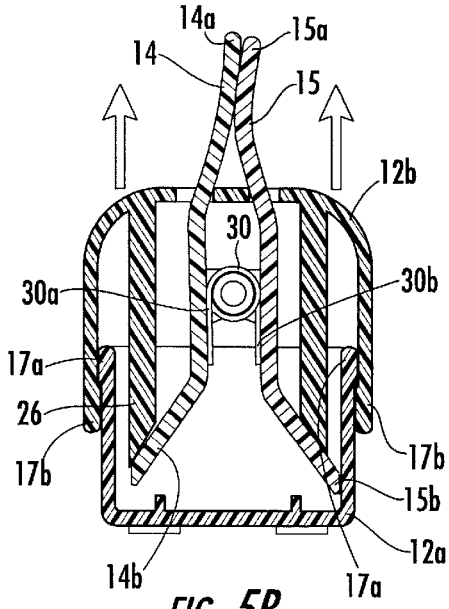
FIG. 5B is a cross-sectional view of the device of FIG. 1 illustrating the housing upper portion in a distal position such that the upper end portions of the arms are urged together so as to removably support an article placed therebetween for viewing.
Figure 6:
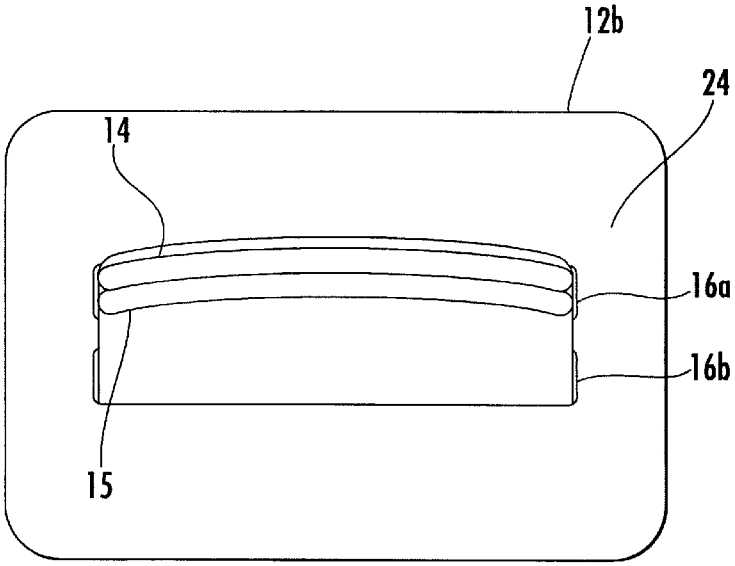
FIG. 6 is a top plan view of the device of FIG. 1.
Figure 7:
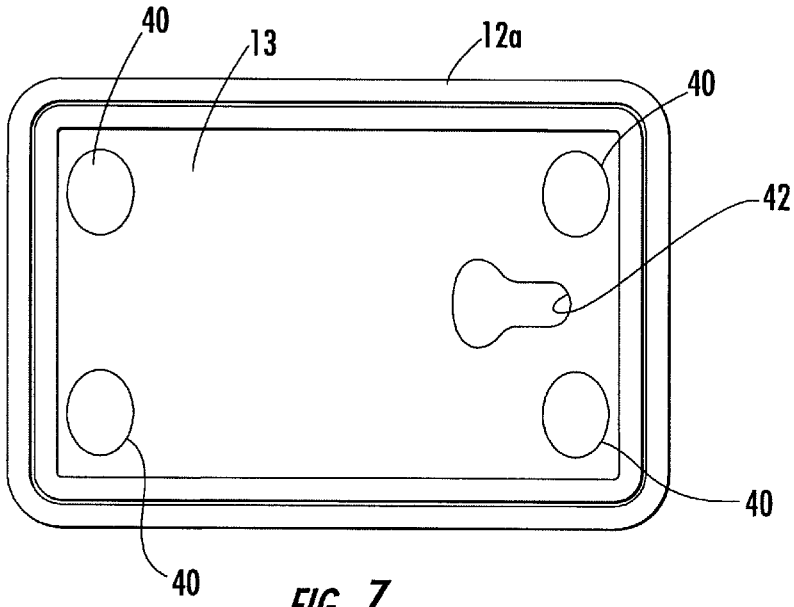
FIG. 7 is a bottom plan view of the device of FIG. 1.

As illustrated in FIGS. 4 and 5A–5B, the arms 14, 15 have upper end portions 14*a*, 15*a* and opposite lower end portions 14*b*, 15*b*. The upper end portions 14*a*, 15*a* of the arms have an arcuate configuration and are configured to matingly engage with each other when the housing upper portion 12*b* is in the distal position, as illustrated in FIG. 6. The lower end portions of the arms 14*b*, 15*b* angle away from each other as illustrated in FIGS. 5A–5B. This configuration facilitates engagement with the housing upper portion 12*b* for causing the upper end portions 14*a*, 15*a* of the arms 14, 15 to pivot away from each other as will be described below. Embodiments of the present invention are not limited to the illustrated configuration of arms 14, 15. Arms 14, 15 may have various configurations without limitation.

The illustrated arms 14, 15 are pivotally disposed within the housing 12 in adjacent spaced-apart relationship. The arms 14, 15 are pivotally supported within the housing base portion 12*a* via a pin 18 which includes an enlarged shaft portion 20 supported within a bearing structure 22, as illustrated. Embodiments of the present invention are not limited to the illustrated pivotal arrangement of arms 14, 15. Arms 14, 15 may be pivotally supported within housing 12 in various ways as would be understood by those skilled in the art.

In the illustrated embodiment, the housing upper portion 12 includes two slots 16*a*, 16*b* within an upper surface 24 thereof. Arm 14 extends through slot 16*a* and arm 15 extends through slot 16*b*. Although two slots 16*a*, 16*b* are illustrated, two slots are not required. A single slot may be utilized for the pair of arms 14, 15 to extend outwardly from the housing upper portion 12*b*.

The housing upper portion 12*b* is configured to engage the lower end portions 14*b*, 15*b* of the arms 14, 15 via members 26 as illustrated in FIGS. 5A–5B. Movement of the housing upper portion 12*b* to the proximal position (FIG. 5A) causes the upper end portions 14*a*, 15*a* of the arms 14, 15 to pivot away from each other so that an article can be placed therebetween.

A spring 30 is disposed within the housing and is configured to urge the upper end portions 14*a*, 15*a* of the arms 14, 15 together so as to removably support an article placed therebetween for viewing. The illustrated spring 30 includes a pair of legs 30*a*, 30*b* that impart a force on respective arms 14, 15. The housing upper portion 12*b* is moved to the distal position (FIG. 5B) when the upper end portions 14*a*, 15*a* of the arms 14, 15 are urged together by the spring 30. The lower end portions 14*b*, 15*b* of arms 14, 15 push upwardly on the members 26 under the force of the spring 30. Embodiments of the present invention are not limited to the illustrated spring. Various types and configurations of springs may be utilized as would be understood by those skilled in the art.

Figure 2:
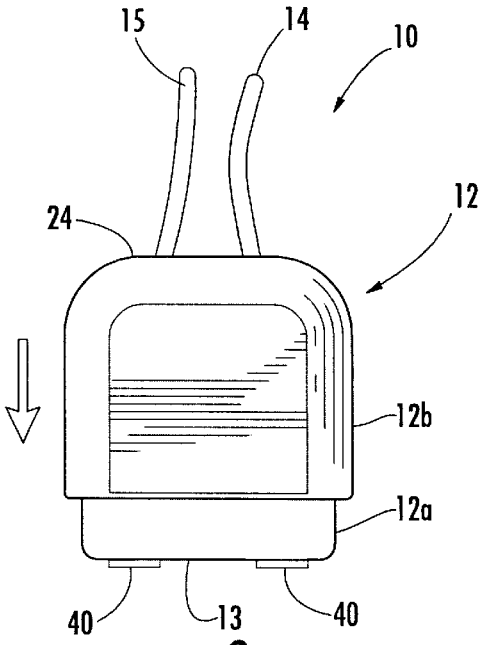
FIG. 2 is an end view of the device of FIG. 1 illustrating the housing upper portion in a proximal position.
Figure 3:
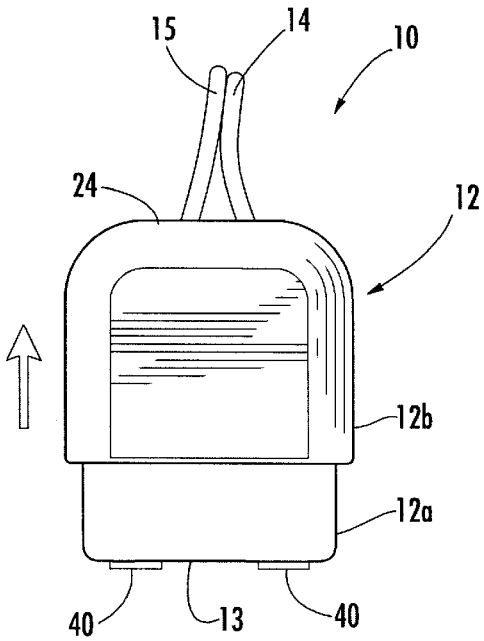
FIG. 3 is an end view of the device of FIG. 1 illustrating the housing upper portion in a distal position.

As illustrated in FIGS. 2 and 3, the bottom surface 13 of the housing base portion 12*a* includes pads 40 that facilitate supporting the device 10 on a surface, such as a table or other generally horizontal surface. The pads 40 may be designed to frictionally engage a surface so as to reduce slippage of the device 10. According to other embodiments of the present invention, the housing base portion 12*a* may be configured to be supported on a substantially non-horizontal surface. In the illustrated embodiment of FIG. 7, an aperture 42 is formed within the bottom surface 13 and is configured to support the device 10 on a wall or other substantially non-horizontal surface via a nail, screw, hook, or other supporting device/member extending from the surface.

In operation, a user moves the housing upper portion 12*b* from the distal position (FIG. 5B) to the proximal position (FIG. 5A), whereby the upper end portions 14*a*, 15*a* of the arms 14, 15 are separated from each other. An article such as a piece of paper, photograph, etc., is placed between the upper end portions 14*a*, 15*a* of the arms 14, 15. The user releases the housing upper portion 12*b* and the spring 30 urges the lower end portions 14*b*, 15*b* of the arms 14, 15 outwardly away from each other to cause the upper end portions 14*a*, 15*a* of the arms 14, 15 to move towards each other. Movement of the arms 14, 15 causes the housing upper portion 12*b* to move to the distal position.

One or more portions of the device 10 may include promotional indicia thereon. For example, promotional indicia may be provided on portions of the housing upper portion 12*b* and/or base portion 12*a*. Promotional indicia may also be provided on one or more of the upper portions 14*a*, 15*a*, of the arms 14, 15. In the illustrated embodiment, promotional indicia 50 is provided on the housing upper portion 12*b*.

Figure 8:
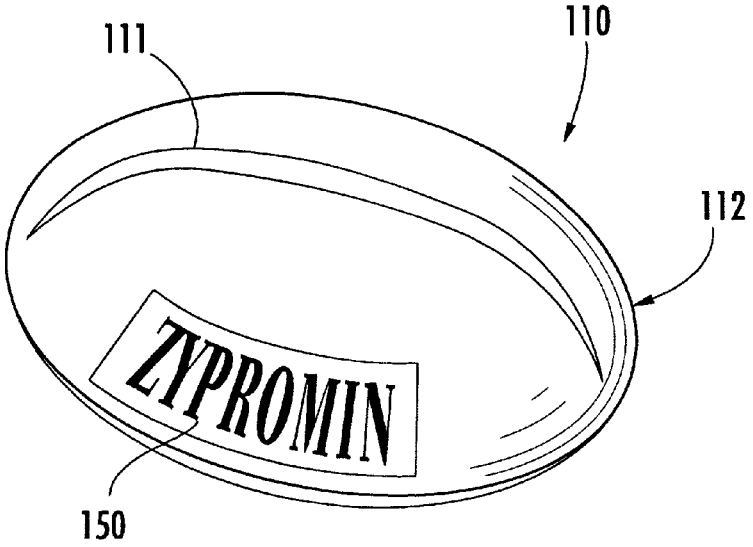
FIG. 8 is a perspective view of a promotional device that is configured to removably support an article for viewing according to embodiments of the present invention.
Figure 9:
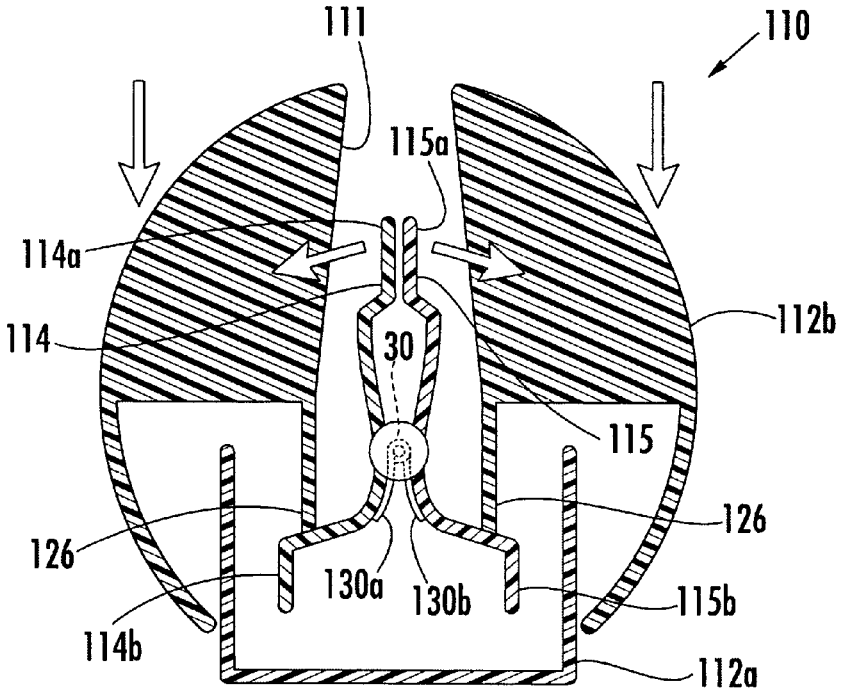
FIG. 9 is a cross-sectional view of the device of FIG. 8 illustrating the housing upper portion in a proximal position such that the upper end portions of the arms are pivoted away from each other so that an article can be placed therebetween.

Referring now to FIGS. 8–9, another promotional device 110 according to embodiments of the present invention that is configured to removably support an article (e.g., paper, photograph, etc.) for viewing is illustrated. The illustrated device 110 is similar in operation to the device 10 of FIGS. 1–7 in that a pair of arms 114, 115 are pivotally disposed within a housing 112 to removably support an article for viewing placed therebetween. The device 110 of FIG. 8 differs from the device 10 of FIGS. 1–7 in that the arms 114, 115 for removably supporting an article for viewing are entirely disposed within the housing 112.

The illustrated housing 112 of device 110 has a base portion 112*a* and an upper portion 112*b* that is movably secured to the base portion 112*a*. The housing upper portion 112*b* includes a slot 111 therein as illustrated. The housing upper portion 112*b* is movable between a distal position and a proximal position relative to the housing base portion 112 in the same manner as describe above for the embodiments of FIGS. 1–7. A pair of arms 114, 115 (FIG. 9) are pivotally disposed within the housing 112 and have upper end portions 114*a*, 115*a* disposed within the housing upper portion 112*b* that are in communication with the slot 111.

In operation, a user moves the housing upper portion 112*b* from the distal position to the proximal position, whereby the upper end portions 114*a*, 115*a* of the arms 114, 115 are separated from each other via members 126 which urge the lower end portions 114*b*, 115*b* of the arms 114, 115 together. An article such as a piece of paper, photograph, etc., is placed between the upper end portions 114*a*, 115*a* of the arms 114, 115. The user releases the housing upper portion 112*b* and a spring 130 within the housing 112 urges the lower end portions 114*b*, 115*b* of the arms 114, 115 outwardly away from each other which causes the upper end portion 114*a*, 115*a* of the arms 114, 115 to move towards each other. The illustrated spring 130 includes a pair of legs 130*a*, 130*b* that impart a force on respective arms 114, 115. Movement of the arms 114, 115 causes the housing upper portion 112*b* to move to the distal position as illustrated and described with respect to the embodiments of FIGS. 1–7.

One or more portions of the device 110 may include promotional indicia thereon. For example, promotional indicia may be provided on portions of the housing upper portion 112*b* and/or base portion 112*a*. In the illustrated embodiment, promotional indicia 150 is provided on the housing upper portion 112*b*.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A device configured to removably support an article for viewing, comprising:

a housing, comprising a base portion configured to be supported on a surface and an upper portion movably secured to the base portion, wherein the upper portion is movable between distal and proximal positions relative to the base portion;

a pair of arms pivotally disposed within the housing in adjacent spaced-apart relationship, wherein the arms have upper end portions and opposite lower end portions, and wherein the housing upper portion is configured to engage the lower end portions of the arms such that movement of the housing upper portion to the proximal position causes the upper end portions of the arms to pivot away from each other so that an article can be placed therebetween; and a spring disposed within the housing that is configured to urge the upper end portions of the arms together so as to removably support the article placed therebetween for viewing.

2. The device of claim 1, wherein the housing upper portion is moved to the distal position when upper end portions of the arms are urged together by the spring.

3. The device of claim 1, wherein the lower end portions of the arms angle away from each other.

4. The device of claim 1, wherein the upper end portions of the arms extend outwardly from the housing upper portion.

5. The device of claim 1, wherein the housing upper end portion comprises a slot, wherein the upper end portions of the arms are disposed within the housing upper portion and in communication with the slot such that the article inserted within the slot can be removably supported by the upper end portions of the arms.

6. The device of claim 1, wherein the upper end portions of the arms have a matingly arcuate configuration.

7. The device of claim 1, wherein the housing base portion is configured to be supported on a substantially non-horizontal surface.

8. A device configured to removably support an article for viewing, comprising:

a housing, comprising a base portion configured to be supported on a surface and an upper portion movably secured to the base portion, wherein the upper portion is movable between distal and proximal positions relative to the base portion, and wherein the upper portion comprises a slot;

a pair of arms pivotally disposed within the housing in adjacent spaced-apart relationship, wherein the arms have upper end portions and opposite lower end portions, wherein the upper end portions of the arms extend outwardly from the housing upper portion via the slot, and wherein the housing upper portion is configured to engage the lower end portions of the arms such that movement of the housing upper portion to the proximal position causes the upper end portions of the arms to pivot away from each other so that the article can be placed therebetween; and a spring disposed within the housing that is configured to urge the upper end portions of the arms together so as to removably support the article placed therebetween for viewing, and wherein the housing upper portion is moved to the distal position when the upper end portions of the arms are urged together by the spring.

9. The device of claim 8, wherein the upper end portions of the arms have a matingly arcuate configuration.

10. The device of claim 8, wherein the lower end portions of the arms angle away from each other.

11. The device of claim 8, wherein the housing base portion is configured to be supported on a substantially non-horizontal surface.

12. A device configured to removably support an article for viewing, comprising:

a housing, comprising a base portion configured to be supported on a surface and an upper portion movably secured to the base portion, wherein the upper portion is movable between distal and proximal positions relative to the base portion, and wherein the housing upper portion comprises a slot;

a pair of arms pivotally disposed within the housing in adjacent spaced-apart relationship, wherein the arms have upper end portions and opposite lower end portions, wherein the upper end portions of the arms are disposed within the housing upper portion in communication with the slot, and wherein the housing upper portion is configured to engage the lower end portions of the arms such that movement of the housing upper portion to the proximal position causes the upper end portions of the arms to pivot away from each other so that the article inserted within the slot can be placed between the upper end portions of the arms; and a spring disposed within the housing that is configured to urge the upper end portions of the arms together so as to removably support the article placed therebetween for viewing.

13. The device of claim 12, wherein the housing upper portion is moved to the distal position when upper end portions of the arms are urged together by the spring.

14. The device of claim 12, wherein the housing wherein the lower end portions of the arms angle away from each other.

15. The device of claim 12, wherein the housing base portion is configured to be supported on a substantially non-horizontal surface.

* * * * *